US005979403A

United States Patent [19]

Brogdon et al.

[11] Patent Number: 5,979,403

[45] Date of Patent: Nov. 9, 1999

[54] FUEL CONTROL SYSTEM FOR AN ENGINE

[75] Inventors: James William Brogdon, Northville; David Keith Gill, Novi, both of Mich.

[73] Assignee: Teledyne Industries, Inc., Los Angeles, Calif.

[21] Appl. No.: 09/124,212

[22] Filed: Jul. 28, 1998

[51] Int. Cl.[6] ..... F02M 21/02

[52] U.S. Cl. ..... 123/373; 123/396

[58] Field of Search ..... 123/373, 396, 123/357, 358, 365, 526, 525, 27 GE, 407; 377/28

[56] References Cited

U.S. PATENT DOCUMENTS

| | | | |
|---|---|---|---|
| 4,187,814 | 2/1980 | Phelan et al. | 123/119 EC |
| 4,212,065 | 7/1980 | Marchak et al. | 123/478 |
| 4,282,840 | 8/1981 | Yamada et al. | 123/412 |
| 4,367,709 | 1/1983 | Codrington | 123/339 |
| 4,472,321 | 9/1984 | Kamohara et al. | 261/39 |
| 4,558,674 | 12/1985 | Okado et al. | 123/425 |
| 4,616,616 | 10/1986 | Staniak et al. | 123/357 |
| 4,785,778 | 11/1988 | Gibson et al. | 123/373 |
| 5,152,271 | 10/1992 | Matsumura | 123/504 |
| 5,161,174 | 11/1992 | Pigozzi | 377/28 |
| 5,273,016 | 12/1993 | Gillespie et al. | 123/403 |
| 5,526,786 | 6/1996 | Beck et al. | 123/357 |

*Primary Examiner*—Willis R. Wolfe
*Assistant Examiner*—Mahmoud M. Gimie
*Attorney, Agent, or Firm*—Robert J. Pugh

[57] ABSTRACT

A fuel control system responsive to a power controller and controlling a fuel delivery system. The fuel control system includes a control arm connected to both the power controller and the fuel delivery system, a position sensor connected to the control arm, and a trim controller connected to the control arm at a pivot point and connected to the position sensor.

43 Claims, 2 Drawing Sheets

FUEL CONTROL SYSTEM FOR AN ENGINE

STATEMENT REGARDING FEDERALLY SPONSORED RESEARCH OR DEVELOPMENT

Certain of the research leading to the present invention was sponsored by the United States government under National Aeronautics and Space Administration (NASA) Cooperative Agreement No. NCC3-515. The United States government may have certain rights in this invention.

CROSS REFERENCE TO RELATED APPLICATIONS

Not Applicable.

BACKGROUND OF THE INVENTION

1. Field of the Invention

The present invention is directed generally to an internal combustion engine and, more particularly, to a fuel control system for use with an internal combustion engine.

2. Description of the Background

Internal combustion engines require control systems in order to operate properly. In particular, diesel engines are difficult to run at idle without an idle speed governor. Diesel engines are controlled by the amount of fuel injected into the cylinders, and that control is often done with a "rack" which forms part of the fuel delivery system. The idle speed governor controls the rack to govern the idle speed. Typically, the idle speed governor is its own system, separate from the system that controls the engine under non-idle operation. The idle speed governor also requires a separate drive and a separate fly ball governor.

Engines, particularly airplane engines, must also compensate for changes in air pressure which occur with changes in altitude. Such compensation is often accomplished with a control that is separate from the idle speed governor. Sometimes the altitude compensation is accomplished with electronics, such as through an electronic fuel injection system.

Therefore, the need exists for a system that allows for electronic control of an engine from idle to full power. There is also a need to control other operating parameters, such as air/fuel mixtures at high altitude. In addition, the need exists for a system that allows for a mechanical backup of the electronic systems.

SUMMARY OF THE INVENTION

The present invention is directed to a fuel control system. The fuel control system is responsive to a power controller and it controls a fuel delivery system. The fuel control system includes a control arm connected to both the power controller and the fuel delivery system, a position sensor connected to the control arm, and a trim controller connected to the control arm at a pivot point and connected to the position sensor.

The present invention is also directed to a fuel system, including a power controller, a fuel delivery system, and the fuel control system. The present invention is also directed to an engine, including a combustion chamber and the fuel system.

The present invention solves problems experienced with the prior art because it provides an electronically trimmed mechanical system that allows for electronic control of engine speed from idle to full power, with a mechanical backup in the event of a failure of the electronic system. The present invention also provides the controls in a single system. Those and other advantages and benefits of the present invention will become apparent from the description of the preferred embodiments hereinbelow.

BRIEF DESCRIPTION OF THE SEVERAL VIEWS OF THE DRAWING

For the present invention to be clearly understood and readily practiced, the present invention will be described in conjunction with the following figures, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, other elements found in typical fuel control and delivery systems. Those of ordinary skill in the art will recognize that other elements may be desirable and/or required in order to implement the present invention. However, because such elements are well known in the art, and because they do not facilitate a better understanding of the present invention, a discussion of such elements is not provided herein. Furthermore, the present invention will generally be described in terms of an airplane, although the present invention is not limited to use with airplanes.

Figure 1:
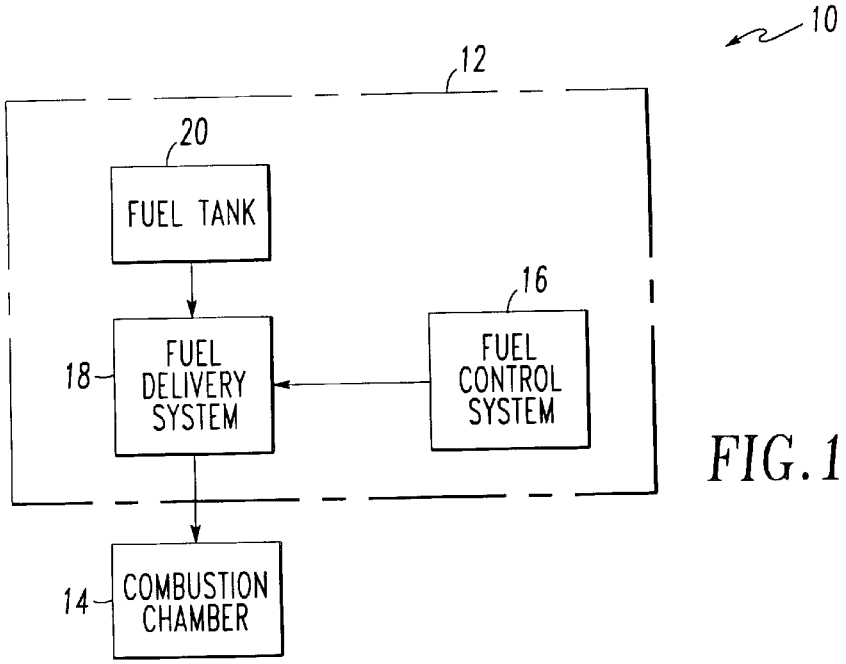
FIG. 1 is a block diagram illustrating an engine including a fuel system and a combustion chamber.

FIG. 1 is a block diagram illustrating an engine 10 including a fuel system 12 and a combustion chamber 14. The engine 10 may be, for example, a two or a four stroke engine, may be fuel injected, and may be designed to operate with diesel fuel.

The fuel system 12 includes a fuel control system 16 which controls a fuel delivery system 18. The fuel delivery system 18 delivers fuel from a fuel tank 20 to the combustion chamber 14. The fuel delivery system 18 is a mechanical system, such as a mechanical rack system. The mechanical rack system may be, for example, a mechanically controlled, fuel injection system.

Figure 2:
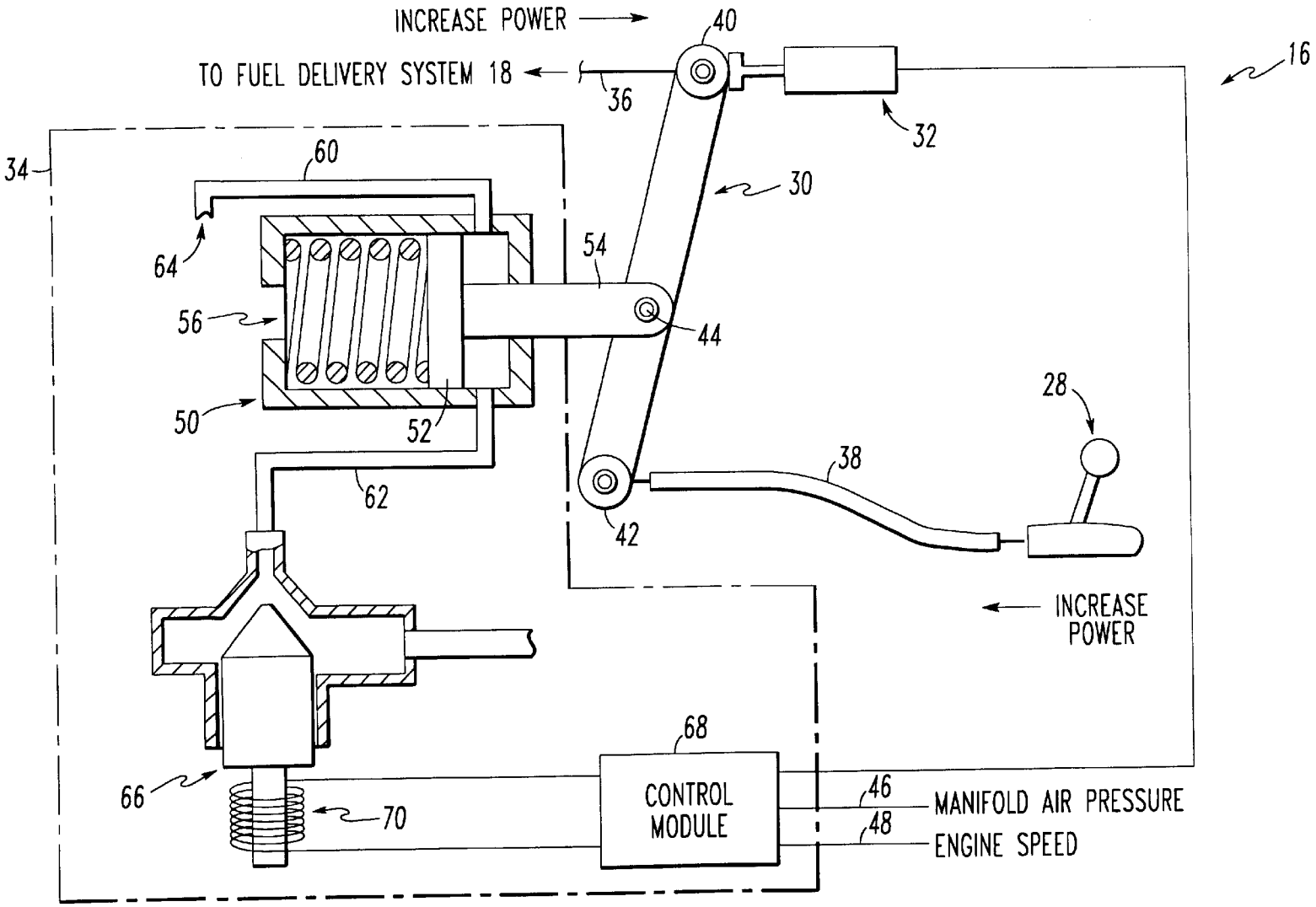
FIG. 2 is a combination block diagram and mechanical schematic illustrating one embodiment of the fuel control system.

FIG. 2 is a combination block diagram and mechanical schematic illustrating the fuel control system 16. A power controller 28 transmits input from a user and may be, for example, a throttle control. The fuel control system 16 also includes a control arm 30, a position sensor 32, and a trim controller 34.

The control arm 30 is connected to both the power controller 28 and the fuel delivery system 18. The control arm 30 may be connected to the fuel delivery system 18 and the power controller 28 via mechanical connections 36, 38 at first and second ends 40, 42, respectively, of the control arm 30. Each of the mechanical connections may be, for example, a cable or a linkage. Mechanical connections 36, 38 offer several advantages, such as reliability, over other types of connections, such as electromechanical connections.

The position sensor 32 may be connected to the first end 40 of the control arm 30. The position sensor 32 produces a signal indicative of a state of the fuel delivery system 18. Because the first end 40 is where the connection 38 connects the control arm 30 to the fuel delivery system 18, the position of the first end 40 is indicative of a state of the fuel delivery system 18.

The trim controller 34 is connected to the control arm 30 at a pivot point 44 and controls the position of the pivot point 44. The trim controller 34 trims the control arm 30, and thereby the fuel delivery system 18, by controlling the pivot point 44. The trimming is accomplished because the second end 42 of the control arm 30 is generally stationary (except when the power controller 28 is being adjusted by a user) and movement of the pivot point 44 causes the control arm 30 to rotate about the pivot point 44, causing the first end 40 of the control arm 30 to move with the pivot point 44, thereby affecting the state of the fuel delivery system 18 via the mechanical connection 36.

The trim controller 34 is also connected to the position sensor 32 to receive the signal indicative of the state of the fuel delivery system 18. The trim controller 34 may also receive other signals, such as signals indicative of manifold air pressure, engine speed, ambient temperature, oil temperature, and oil pressure. In the illustrated embodiment, the trim controller 34 receives signals 46, 48 indicative of the manifold air pressure and engine speed. The signal 46 indicative of manifold air pressure may be, for example, air pressure from the manifold that is received by the trim controller 34 at a pressure measurement transducer, or the signal 46 may be an electrical or optical signal indicative of the manifold air pressure.

The trim controller 34 may be any of several types of electrically actuated controllers. For example, the trim controller 34 may be electro-hydraulically actuated or electro-mechanically actuated. In the illustrated embodiment, the trim controller 34 is electro-hydraulic and includes a cylinder 50, a piston 52 within the cylinder 50, and a connector 54 connecting the piston 52 to the pivot point 44 of the control arm 30. A spring 56 may be provided within the cylinder 50 to bias the piston 52 in an position that is advantageous in the event of a failure of the hydraulic system. In the illustrated embodiment, the spring 56 biases the pivot point 44 in a "full power" position, which will cause the engine to idle at a higher speed than is normal, but is acceptable for emergency maneuvers in the event of a malfunction.

An inlet connection 60 provides hydraulic fluid to the cylinder 50, and an outlet connection 62 carries the hydraulic fluid away from the cylinder 50. The inlet connection 60 may connect the cylinder 52 to the gallery of the engine via an inlet orifice 64 to provide pressurized engine oil as the hydraulic fluid.

A modulating valve 66 modulates the flow of the hydraulic fluid from the cylinder 50 via the outlet connection 62. When engine oil is used as the hydraulic fluid, the modulating valve 66 may be connected to the engine so that the engine oil returns to the engine after it passes the modulating valve 66. The opening of the modulating valve 66 may be larger than the opening of the orifice 64 so that, when the modulating valve is open, the rate at which hydraulic fluid is removed from the cylinder 50 is greater than the rate at which it enters the cylinder 50.

A control module 68 receives the signal from the position sensor 32 and may receive other signals, such as signals indicative of manifold air pressure, engine speed, ambient temperature, oil temperature, and oil pressure. In the illustrated embodiment, the control module 68 receives signals 46, 48 indicative of the manifold air pressure and the engine speed. The control module 68 controls the modulating valve 66, thereby controlling the hydraulic pressure within the cylinder 50, which controls the position of the pivot point 44. For example, if the engine speed is to be increased, the control module 68 will open the modulating valve 66 to reduce the hydraulic pressure within the cylinder 50. If the engine speed is to be reduced, the control module 68 will close the modulating valve 66 and the hydraulic pressure within the cylinder 50 will increase. If the engine speed is to be maintained, the control module 68 will open and close the modulating valve 66 so as to maintain a constant hydraulic pressure in the cylinder 50. In the illustrated embodiment, the modulating valve 66 is a solenoid valve, and the control module 68 controls the modulating valve 66 by controlling current through coils of a solenoid 70. The modulating valve 66 may be controlled in other ways. For example, the modulating valve 66 may be controlled by an electric motor, such as a stepper motor. The control module 68 may include an application specific integrated circuit ("ASIC"), or it may include a general purpose processor, such as a Pentium® processor manufactured by Intel Corp., Santa Clara, Calif.

Under normal operation, the trim controller 34 adjusts the pivot point 44 to provide advantageous operation of the fuel delivery system 18. For example, when the trim controller 34 senses that the power controller 28 is in a position indicative of an idle condition, it will adjust the pivot point 44 to keep the engine speed within an optimum range. When the trim controller 34 senses that the air pressure has changed and the power controller 28 is in a position indicative of flight, such as during a high altitude flight, the trim controller 34 will adjust the pivot point to obtain a desired air/fuel mixture based on factors such as engine speed, manifold air pressure, and other factors. The control module 68 includes a map of manifold air pressure versus the state of the fuel delivery system 18 as sensed by the position sensor 32 to facilitate control of the pivot point 44.

The present invention provides for electronic trimming of a mechanical system, with mechanical override of the system in the event of failure. The present invention may be used to control and adjust the fuel delivery system 18 from idle to full power in a single system. The combination of mechanical and electronic controls provides advantages of electronic control, with the safety of mechanical control to override the system in the event of a failure in the electronic or hydraulic systems. In smaller aircraft, for example, it is particularly advantageous to provide mechanical controls for important functions, such as the fuel system 12.

Figure 3:
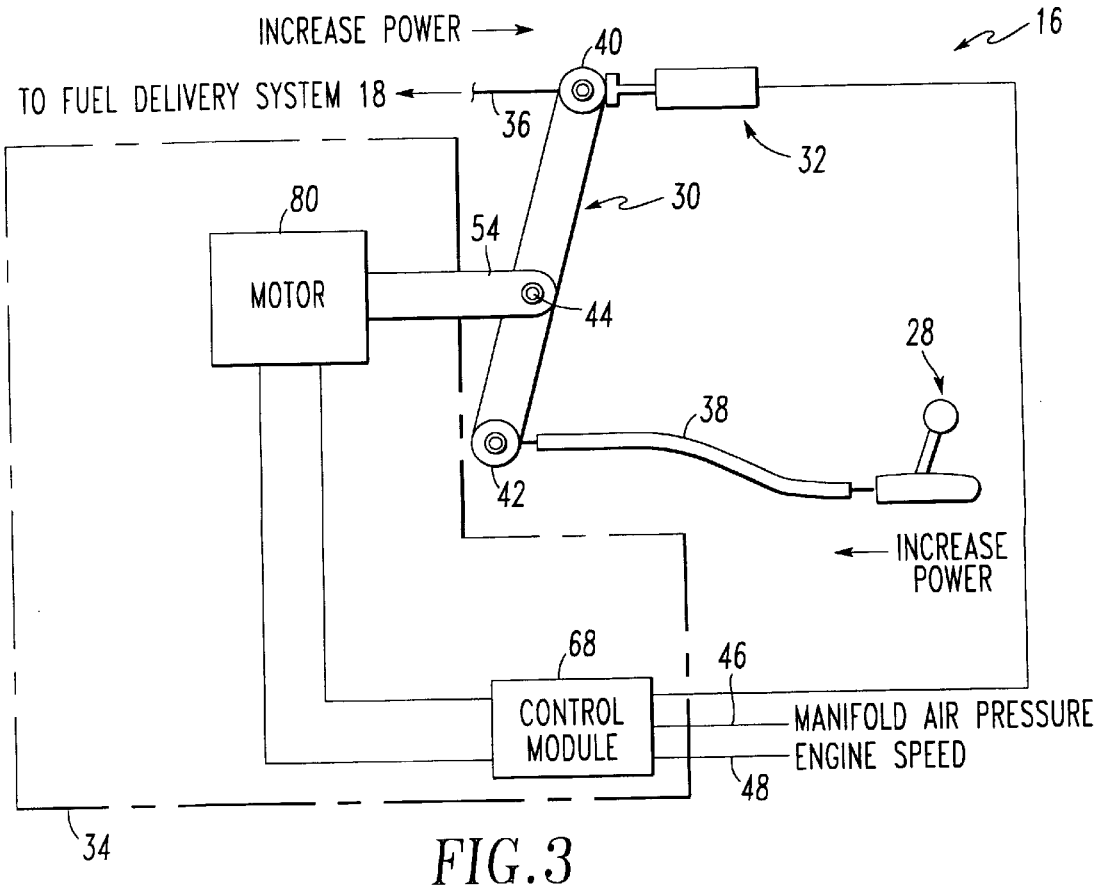
FIG. 3 is a combination block diagram and mechanical schematic illustrating an alternative embodiment of the fuel control system including an electromechanical trim controller.

FIG. 3 is a combination block diagram and mechanical schematic illustrating an alternative embodiment of the fuel control system 16. In that embodiment, the trim controller 34 is electro-mechanically actuated and includes an electric motor 80, such as a stepper motor. The motor 80 is connected to the connector 54 and adjusts the position of the pivot point 44 in a manner analogous to that described with respect to FIG. 2.

Those of ordinary skill in the art will recognize that many modifications and variations of the present invention may be implemented. For example, although certain signals have been described as being used with the control module 68, other signals may also be used to accomplish the same or similar results. The foregoing description and the following claims are intended to cover all such modifications and variations.

We claim:

1. A fuel control system responsive to a power controller and controlling a fuel delivery system, comprising:

a control arm mechanically-connected to both the power controller and the fuel delivery system;

a position sensor connected to said control arm; and an electrically-actuated trim controller connected to said control arm at a pivot point and connected to said position sensor.

2. The system of claim 1, wherein said control arm includes:

a first end at which said control arm is connected to said position sensor and the fuel delivery system; and a second end at which said control arm is connect to the power controller.

3. The system of claim 1, wherein said trim controller is electrically actuated.

4. The system of claim 3, wherein said trim controller is electro-mechanically actuated.

5. The system of claim 3, wherein said trim controller is electro-hydraulically actuated.

6. The system of claim 1, wherein said trim controller includes:

a cylinder;

a piston within said cylinder; and a connector connected to said piston and connected to said pivot point of said control arm.

7. The system of claim 6, wherein said trim controller includes:

an inlet connector connected to said cylinder;

an outlet connector connected to said cylinder;

a modulating valve connected to said outlet connector; and a control module connected to said modulating valve.

8. The system of claim 7, wherein said modulating valve includes a solenoid.

9. The system of claim 1, wherein said trim controller includes:

a motor; and a connector connected to said motor and connected to said pivot point of said control arm.

10. The system of claim 9, wherein said motor is a stepper motor.

11. The system of claim 9, wherein said trim controller includes a control module connected to said motor.

12. The system of claim 1, wherein said trim controller includes means for adjusting said control arm.

13. The system of claim 12, wherein said means for adjusting is electric.

14. The system of claim 13, wherein said means for adjusting includes a motor.

15. The system of claim 13, wherein said means for adjusting includes a cylinder, a piston, and a modulating valve.

16. The system of claim 13, wherein said means for adjusting includes a control module.

17. A fuel system, comprising:

a power controller;

a fuel delivery system;

a control arm mechanically-connected to both said power controller and said fuel delivery system;

a position sensor connected to said control arm; and an electrically-actuated trim controller connected to said control arm at a pivot point and connected to said position sensor.

18. The system of claim 17, wherein said power controller is mechanically actuated.

19. The system of claim 17, wherein said fuel delivery system is mechanically actuated.

20. The system of claim 17, wherein said trim controller is electrically actuated.

21. The system of claim 17, wherein said fuel delivery system includes a fuel injector.

22. The system of claim 17, wherein said fuel delivery system includes a rack.

23. The system of claim 17, wherein said power controller includes a throttle control.

24. A fuel system, comprising:

a mechanically actuated power controller;

a mechanically actuated fuel delivery system;

a control arm mechanically-connected to both said power controller and said fuel delivery system;

a position sensor connected to said control arm; and an electro-hydraulically actuated trim controller, including:

a cylinder;

a piston within said cylinder;

a connector connected to said piston and connected to a pivot point of said control arm;

an inlet connector connected to said cylinder;

an outlet connector connected to said cylinder;

a modulating valve connected to said outlet connector; and a control module connected to said modulating valve and connected to said position sensor.

25. A fuel system, comprising:

a mechanically actuated power controller;

a mechanically actuated fuel delivery system;

a control arm mechanically-connected to both said power controller and said fuel delivery system;

a position sensor connected to said control arm; and an electro-mechanically actuated trim controller, including:

a motor;

a connector connected to said motor and connected to a pivot point of said control arm; and a control module connected to said motor and connected to said position sensor.

26. An engine, comprising:

a combustion chamber; and a fuel system including a fuel control system and a fuel delivery system connected to said combustion chamber, said fuel control system including:

a power controller;

a control arm mechanically-connected to both said power controller and said fuel delivery system;

a position sensor connected to said control arm; and an electrically-actuated trim controller connected to said control arm at a pivot point and connected to said position sensor.

27. The engine of claim 25, wherein said fuel delivery system is mechanically actuated.

28. The engine of claim 25, wherein said fuel delivery system includes a rack.

29. The engine of claim 25, wherein said fuel delivery system includes a fuel injector.

30. The engine of claim 25, wherein said trim controller is electrically actuated.

31. The engine of claim 25, wherein said power controller is mechanically actuated.

32. A fuel control system responsive to a power controller and for controlling a fuel delivery system, comprising:

means for influencing the fuel delivery system, said means being mechanically-connected to the power controller;

means for determining a state of the fuel delivery system;

means for trimming the fuel delivery system, said means being responsive to said means for determining and being electrically-actuated.

33. The system of claim 32, wherein said means for influencing includes a control arm connected to both the power controller and the fuel delivery system.

34. The system of claim 33, wherein said means for influencing is mechanically actuated.

35. The system of claim 32, wherein said means for determining includes a position sensor connected to said means for influencing.

36. The system of claim 32, wherein said means for determining produces a signal indicative of the state of the fuel delivery system.

37. The system of claim 36, wherein the signal is provided to said means for trimming.

38. The system of claim 32, wherein said means for trimming includes an electrically actuated trim controller connected to said means for influencing.

39. The system of claim 32, wherein said means for trimming includes:

a cylinder;

a piston within said cylinder;

a connector connected to said piston and connected to said means for influencing.

40. The system of claim 39, wherein said means for trimming includes a control module connected to said cylinder and responsive to said means for determining.

41. The system of claim 40, wherein said control module is connected to said cylinder via a modulating valve.

42. The system of claim 32, wherein said means for trimming includes:

a motor; and a connector connected to said motor and connected to said means for influencing.

43. The system of claim 42, wherein said means for trimming includes a control module connected to said motor and responsive to said means for determining.

* * * * *